US009920489B2

(12) United States Patent
Boutillier et al.

(10) Patent No.: US 9,920,489 B2
(45) Date of Patent: Mar. 20, 2018

(54) ROADWAY WIDENING STRUCTURE

(71) Applicant: TECHNOLOGIE ALPINE DE SECURITE-TAS, Sainte-helene-du-lac (FR)

(72) Inventors: Benoît Boutillier, Voiron (FR); Stéphane Constant, Saint Pierre d'allevard (FR); Cyril Lambert, Talloires (FR)

(73) Assignee: TECHNOLOGIE ALPINE DE SECURITE—TAS, Sainte-Helene-du-Lac (FR)

( * ) Notice: Subject to any disclaimer, the term of this patent is extended or adjusted under 35 U.S.C. 154(b) by 0 days.

(21) Appl. No.: 15/120,461

(22) PCT Filed: Feb. 13, 2015

(86) PCT No.: PCT/FR2015/050358

§ 371 (c)(1),
(2) Date: Aug. 19, 2016

(87) PCT Pub. No.: WO2015/124852

PCT Pub. Date: Aug. 27, 2015

(65) Prior Publication Data

US 2017/0030025 A1 Feb. 2, 2017

(30) Foreign Application Priority Data

Feb. 20, 2014 (FR) ..... 14 51359

(51) Int. Cl.
*E01C 3/04* (2006.01)
*E01C 3/00* (2006.01)
*E01C 1/00* (2006.01)

(52) U.S. Cl.
CPC ..... *E01C 3/006* (2013.01); *E01C 1/00* (2013.01); *E01C 3/00* (2013.01)

(58) Field of Classification Search
CPC ..... E01C 1/00; E01C 3/006; E01C 3/04
(Continued)

(56) References Cited

U.S. PATENT DOCUMENTS 5,106,227 A * 4/1992 Ahmad ..... E01C 11/165 404/134
5,123,777 A * 6/1992 Tadros ..... E01D 1/00 14/73

(Continued)

FOREIGN PATENT DOCUMENTS

FR 2436331 A1 11/1980
JP 2-101205 A 4/1990

(Continued)

OTHER PUBLICATIONS

International Search Report dated Apr. 14, 2015 re: Application No. PCT/FR2015/050358; pp. 1-2; citing: KR 101 021 137 B1 (Kyung, K, et al.); KR 101 018 537 B1 (Ari Ind Co Ltd); FR 2 436 331 A1 (Alexandre, S); and JP H02 101205 A (Mamoru, U.).

*Primary Examiner* — Gary S Hartmann
(74) *Attorney, Agent, or Firm* — Cantor Colburn LLP

(57) ABSTRACT

A roadway widening structure including a first portion configured to bear on a support and configured to support a first part of the roadway, the first portion including a frame which has a parallelepiped shape and which includes an enclosure having a parallelepiped shape and configured to receive ballast so as to immobilize the first portion on the support, a lower enclosure wall of the enclosure including a first lattice, a second portion cantilevered, secured to the first portion by a lateral wall and configured to support a second part of the roadway, a lateral enclosure wall of the enclosure, facing the second portion of the roadway widening structure, including a second lattice, and for fastening the first portion and the second portion.

10 Claims, 3 Drawing Sheets

(58) Field of Classification Search
USPC ..... 404/27, 28, 29, 70; 405/302.4, 302.7
See application file for complete search history.

(56) References Cited

U.S. PATENT DOCUMENTS

| | | | | |
|---|---|---|---|---|
| 7,249,912 | B2 * | 7/2007 | Reese | B63B 3/08 404/31 |
| 7,993,080 | B2 * | 8/2011 | Erez | E02D 17/20 405/284 |
| 8,376,661 | B2 * | 2/2013 | Barrett | E01C 1/00 405/262 |
| 2015/0191878 | A1 * | 7/2015 | White | E01C 11/16 404/70 |

FOREIGN PATENT DOCUMENTS

| | | | |
|---|---|---|---|
| KR | 101018637 | B1 | 3/2011 |
| KR | 101021137 | B1 | 3/2011 |

* cited by examiner

ROADWAY WIDENING STRUCTURE

TECHNICAL FIELD

The present invention relates to the technical field of the traffic roadway foundations and concerns in particular a roadway widening structure.

BACKGROUND

It is known to fill in portions of traffic roadways so as to be able to widen them.

However, the backfill set-up requires the construction of road structures necessary for maintaining the backfill and requires a significant supply of materials.

BRIEF SUMMARY

The present disclosure aims to solve all or part of the aforementioned drawbacks.

To this end, a roadway widening structure is provided comprising:

- a first portion intended to bear on a support and intended to support a first portion of the roadway, the first portion presenting an enclosure intended to receive ballast so as to immobilize the first portion on the support, and
- a cantilevered second portion, secured to the first portion by a lateral wall and intended to support a second portion of the roadway.

This arrangement allows widening a roadway while avoiding the construction of a dedicated road structure and allows considerably reducing the required amount of backfill.

This arrangement also allows immobilizing the first portion on the support by filling the enclosure with materials available on the installation site.

According to one aspect of the invention, the roadway widening structure includes fastening means for fastening the first portion and the second portion.

According to one aspect of the invention, the second portion is removable.

This arrangement allows facilitating the transportation of the widening structure while facilitating its set-up, its manufacture and its maintenance.

According to one aspect of the invention, the fastening means comprise translational guide elements.

This arrangement allows assembling the first portion and the second portion easily.

According to one aspect of the invention, the translational guide elements comprise rails disposed on the first portion or respectively the second portion and complementarily-shaped guides disposed on the second portion or respectively the first portion.

According to one aspect of the invention, at least one wall of the enclosure comprises a lattice.

This arrangement allows retaining materials having a size larger than the meshing of the lattice, for example stones, and distributing the weight of these materials all over the bottom of the enclosure.

According to one aspect of the invention, the first portion comprises means for anchoring on the support.

This arrangement allows fastening the first portion on the support when the latter is stable enough.

According to one aspect of the invention, the first portion presents a first retaining surface for retaining a coating and the second portion presents a second retaining surface for retaining a coating, the first retaining surface and the second retaining surface being located substantially in the same plane.

This arrangement allows homogenizing the thickness of the coating intended to cover the widening structure.

According to one aspect of the invention, the second retaining surface presents a triangular shape.

This arrangement allows lightening the second portion.

According to one aspect of the invention, the lateral wall of the second portion is common with a wall of the first portion.

This arrangement allows reducing the amount of material necessary for the manufacture of the widening structure.

According to one aspect of the invention, the second portion comprises on its end opposite to the first portion an angle bar extending transverse to a retaining surface of the second portion.

This arrangement allows considering fastening signaling or safety elements on the edge of the traffic roadway widened by setting up the roadway widening structure.

BRIEF DESCRIPTION OF THE DRAWINGS

In any case, the invention will be better understood from the description that follows, with reference to the appended schematic drawing representing, as a non-limiting example, a roadway widening structure according to the invention.

DETAILED DESCRIPTION

Figure 1:
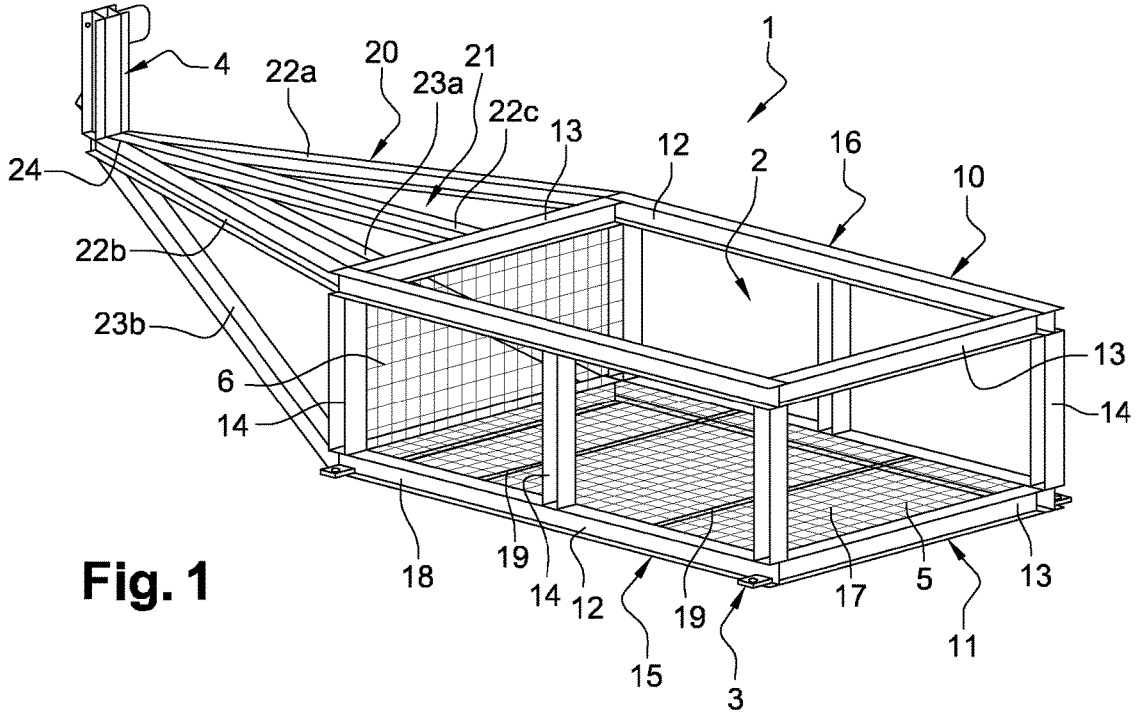
FIG. 1 illustrates a first embodiment of a widening structure according to the invention.
Figure 4:
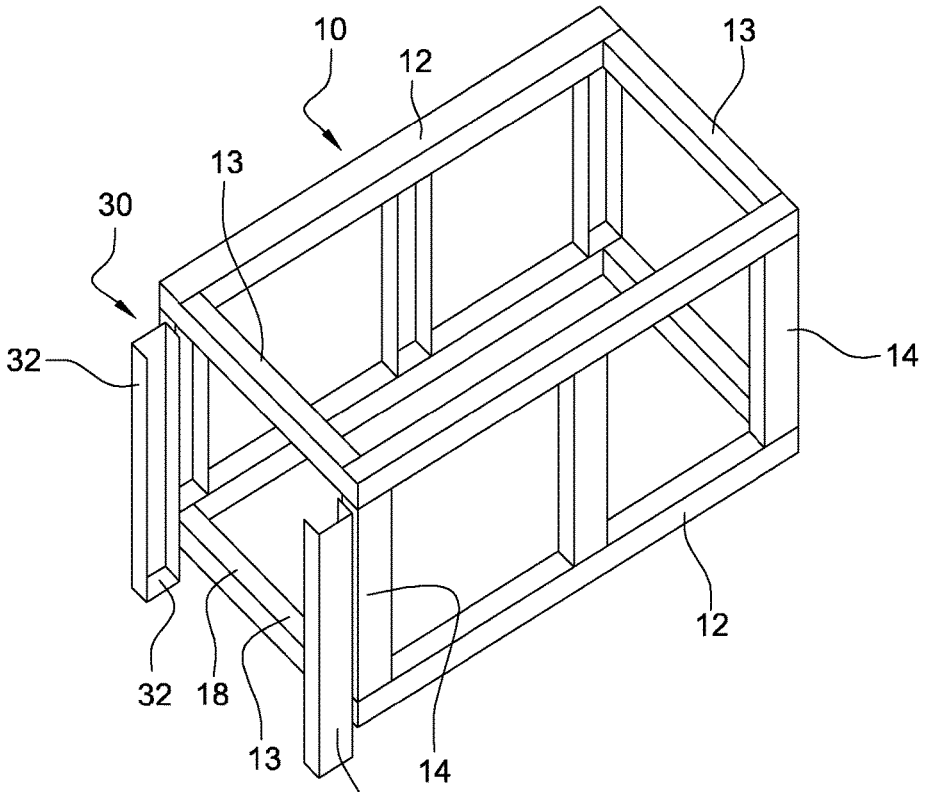
FIG. 4 illustrates a first portion of a second embodiment of a widening structure according to the invention.

As illustrated in FIGS. 1 and 4, a roadway widening structure 1 comprises a first portion 10 and a second portion 20.

The first portion 10 is intended to bear on a support (not illustrated) such as the ground and intended to support a first portion of the roadway.

Moreover, the first portion 10 is intended to be placed preferably on the boundary of a wall.

To this end, it may be necessary to dig the wall so as to obtain a horizontal support presenting a size sufficient to enable receiving the first portion 10.

The second portion 20 is cantilevered, secured to the first portion 10 by a lateral wall and intended to support a second portion of the roadway.

The cantilevered arrangement means that this second portion 20 has no direct link with the support.

The characteristics of the lateral wall securing the second portion 20 to the first portion 10 are detailed later in the text.

In the disclosed embodiments, the second portion 20 is connected to the first portion 10 by fastening means 30.

Examples of these fastening means 30 are provided later in the text.

The first portion 10 comprises a frame 11 presenting a parallelepiped shape.

The frame 11 is formed by an assembly of longitudinal members 12, cross members 13 and girders 14.

For example, these longitudinal members 12, cross members 13 and girders 14 are I-beams with a normal profile commonly called IPN.

The assembly of these beams together is achieved by welding or by any other means or method of assembly.

The frame 11 presents a base 15 and a first retaining surface 16.

The base 15 is intended to bear on the support.

The first retaining surface 16 is intended to support a coating (not illustrated) of the roadway.

Each of the base 15 and of the first retaining surface 16 of the frame 11 is formed by two longitudinal members 12 and two cross members 13 assembled at their ends so as to obtain a substantially rectangular shape.

Furthermore, the base 15 and the first retaining surface 16 of the frame 11 are separated by at least four girders 14, among which at least four girders 14 are disposed at the ends of the longitudinal members 12 and of the cross members 13 thereby conferring to the frame its parallelepiped shape. Other girders 14 may be disposed along the longitudinal members 12.

The thus assembled first portion 10 forms an enclosure 2.

The base 15 of the frame 11 forming the bottom 17 of the enclosure 2 also presents two support cross members 19 joining its two longitudinal members 12 and on which a lattice 5 presenting a determined mesh rests jointly with the other elements of the base 15.

This lattice 5 may also be set on the different elements 12, 13, 14 composing the bottom 17 of the frame 11 or still it may be welded to one or more of these elements.

A second lattice 6 is arranged between a cross member 13 of the base 15 and a cross member 13 of the first retaining member 16 facing the second portion 20 of the widening structure 1.

This second lattice 6 presents a mesh similar to that of the first lattice 5.

Thus, the enclosure 2 can receive ballast (not illustrated).

For example, this ballast may comprise rocks having dimensions larger than those of the mesh of the first lattice 5 and of the second lattice 6.

The roadway widening structure 1 is intended to cooperate with other widening structures of the same type so as to be able to widen the roadway.

These roadway widening structures 1 are also intended to lean against an existing wall.

Consequently, it is not necessary to dispose additional lattices on other walls of the enclosure 2 of the first portion 10 of the roadway widening structure 1.

Indeed, the used ballast, for example rocks, is distributed on the different bases 15 of the different frames 11 of several roadway widening structures 1.

The weight of the ballast maintains the first portion 10 of the roadway widening structure 1 in a stable way on a location of the support arranged in the wall.

In the case where the weight of the ballast would be not enough for maintaining the roadway widening structure 1 in a stable way, the frame 11 of the first portion 10 may comprise anchoring means 3 on the outside of its base 15.

In the disclosed example, these anchoring means 3 comprise pierced transverse legs projecting from the longitudinal members 12 forming the base 15 of the frame 11 of the first portion 10.

The second portion 20 of the roadway widening structure 1 comprises in turn a second retaining surface 21 and two reinforcing girders 23*a*, 23*b*.

The second retaining surface 21 comprises three beams 22*a*, 22*b*, 22*c*.

For example, the second retaining surface 21 and the two reinforcing girders 23*a*, 23*b* are also formed by I-beams with a normal profile commonly called IPN.

Figure 2:
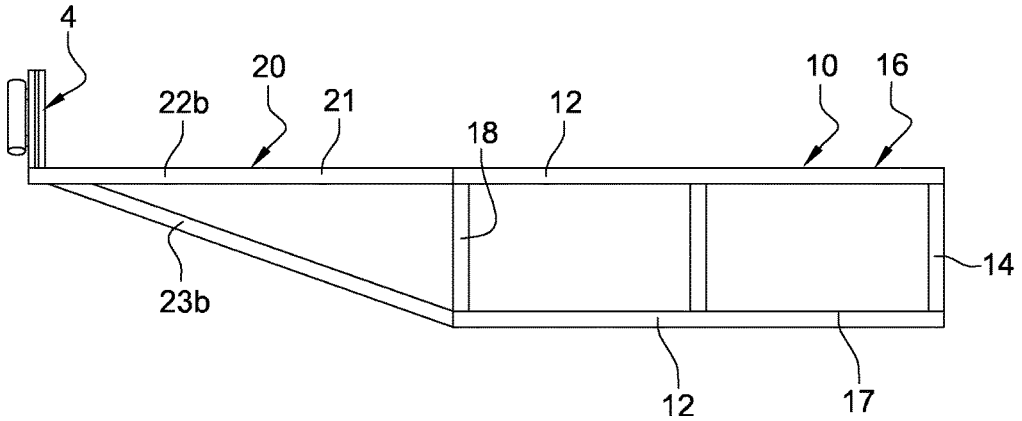
FIG. 2 is a side view of the widening structure of FIG. 1.
Figure 3:
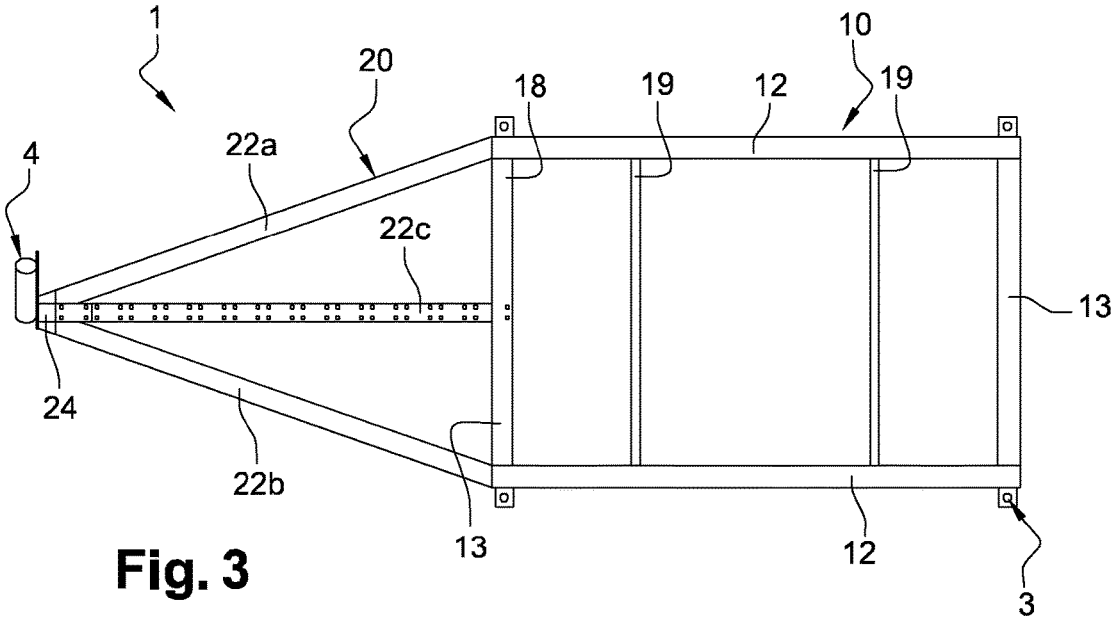
FIG. 3 is a top view of the widening structure of FIG. 1.

In the first embodiment illustrated in FIGS. 1 to 3, the second portion 20 presents a lateral wall common with the first portion 10 thereby securing the second portion 20 to the first portion 10.

This common wall is formed by a wall 18 of the enclosure 2 which is in turn formed by a cross member 13 of the base 15 of the frame 11, a cross member 13 of the first retaining surface 16 of the frame 11 and two girders 14 of the frame 11 joining these two cross members 13.

In the first embodiment, the lattice 19 is disposed on this wall 18.

The three beams 22*a*, 22*b*, 22*c* forming the second retaining surface 21 extending from the cross member 13 of this wall 18 and of the first retaining surface 16 of the frame 11 so that the two retaining surfaces 16, 21 are disposed substantially in the same plane.

More specifically, two of these beams 22*a*, 22*b* extend from the ends of this cross member 13 of the first retaining surface 16 of the frame 11 of the first portion 10.

The third beam 22*c* extends in turn from an area located at the middle of the two ends of this same cross member 13 of the first retaining surface 16 of the frame 11 of the first portion 10.

These three beams 22*a*, 22*b*, 22*c* converge substantially into the same point of convergence 24, which confers a triangular shape to the second retaining surface.

The reinforcing girders 23*a*, 23*b* extend in turn from the ends of the cross member 13 of the base 15 up to the point of convergence 24.

At this point of convergence 24, the second portion 20 comprises an angle bar 4 extending in the direction opposite to the reinforcing girders 23*a*, 23*b* and transverse to the second retaining surface 21 of the second portion 20.

This angle bar 4 may subsequently be used for fastening signaling or safety elements on the edge of the traffic roadway widened by means of the roadway widening structure 1.

All the elements 22*a*, 22*b*, 22*c*, 23*a*, 23*b* of the second portion 20 are welded together.

Furthermore, the roadway widening structure 1 comprises means 30 for fastening the second portion 20 on the first portion 10.

In this first embodiment, these fastening means 30 comprise welds connecting, in a non-removable manner, the second portion 20 to the first portion 10 of the roadway widening structure 1.

Thus, the roadway widening structure 1 is formed in one piece.

Figure 5:
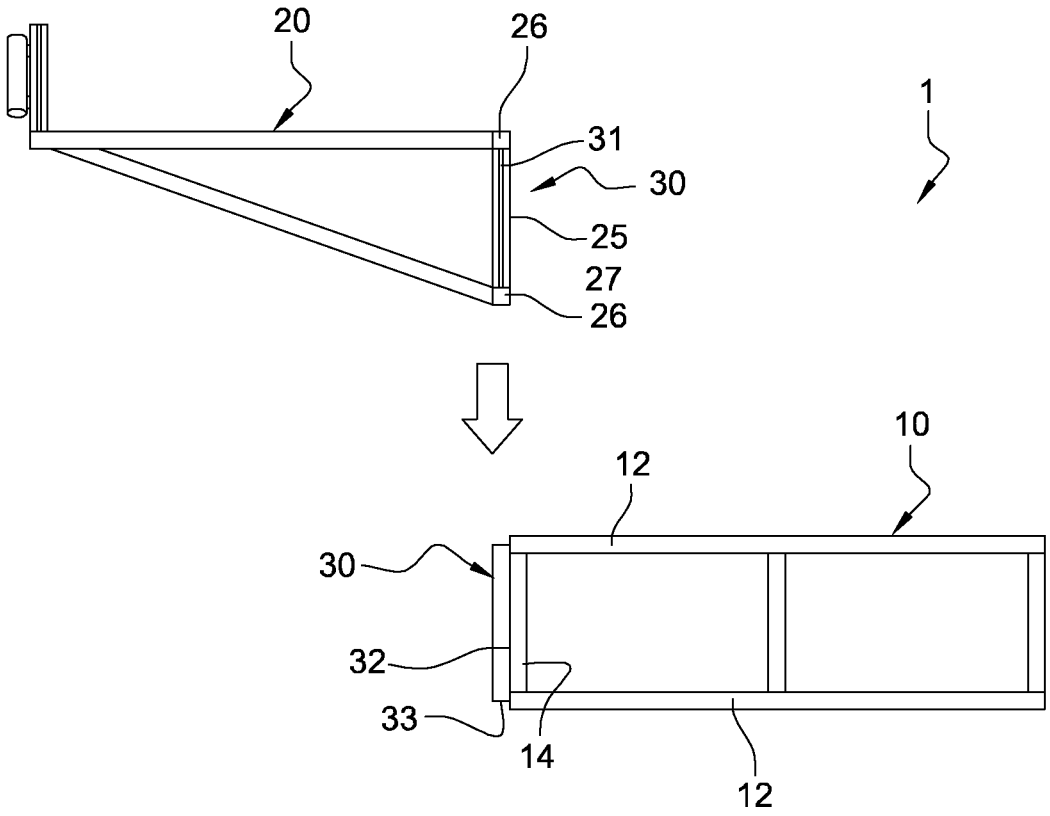
FIG. 5 illustrates a mounting phase of two portions of a widening structure according to the second embodiment of the invention.

In a second embodiment illustrated in FIGS. 4 to 5, the roadway widening structure 1 differs from the first embodiment in that it comprises fastening means 30 allowing making the second portion 20 removable.

Thus, it is possible to detach the second portion 20 from the first portion 10 so as to facilitate the transportation of the roadway widening structure 1, its handling or its manufacture.

In this second embodiment, the second portion 20 presents a lateral wall 25 independent from the previous wall 18 of the enclosure 2 of the first embodiment securing the second portion 20 to the first portion 10.

This lateral wall 25 comprises, on the one hand, two cross members 26 one of which joins the ends of the three beams 22*a*, 22*b*, 22*c* together and the other joins the ends of the two reinforcing girders 23*a*, 23*b*, and comprises, on the other hand, two girders 27 one of which joins the end of the first beam 22*a* and the end of the reinforcing girder 23*a* and the other joins the end of the second beam 22*b* and the end of the second reinforcing girder 23*b*.

In the example disclosed to illustrate this second embodiment, the fastening means 30 comprise in turn translation guide elements 31, 32 including guides 31 disposed on the two girders 27 forming the lateral edges of the independent lateral wall 25 of the second portion 20 and complementary rails 32 disposed in a facing manner on the girders 14 of the wall 18 of the enclosure 2.

As illustrated in FIG. 5, fastening the second portion 20 to the first portion 10 is done by inserting the guides 31 in the rails 32.

An abutment (not illustrated) may be provided on an upper portion of the guides 31 or on a lower portion of the rails 32 so as to retain the guides 31 in the rails 32.

The support may also ensure an abutment function thereby making the set up of a specific means obsolete.

Although the invention has been described in connection with particular embodiments, it is evident that it is not limited thereto and that it comprises all technical equivalents of the described means as well as their combinations.

This is how the first portion 10 and the second portion 20 may present common elements, in particular longitudinal members 12, and consequently may not include fastening means 30.

It is also possible to consider other fastening means 30 so as to make the second portion 20 removable, in particular fastening screws or axes blocked by pins disposed at the ends of the different axes.

The present invention finds an industrial application in widening roads in cliff-side areas but also more particularly in widening ski slopes.

The invention claimed is:

1. A roadway widening structure comprising:

a first portion configured to bear on a support and configured to support a first part of the roadway, the first portion including a frame which has a parallelepiped shape and which includes an enclosure having a parallelepiped shape and configured to receive ballast so as to immobilize the first portion on the support, a lower enclosure wall of the enclosure including a first lattice, a second portion cantilevered, secured to the first portion by a lateral wall and configured to support a second part of the roadway, a lateral enclosure wall of the enclosure, facing the second portion of the roadway widening structure, including a second lattice, and fastening means for fastening the first portion and the second portion.

2. The roadway widening structure according to claim 1, wherein the second portion is removable.

3. The roadway widening structure according to claim 1, wherein the fastening means comprise translation guide elements.

4. The roadway widening structure according to claim 3, wherein the translation guide elements comprise rails disposed on the first portion or respectively the second portion and complementarily-shaped guides disposed on the second portion or respectively the first portion.

5. The roadway widening structure according to claim 1, wherein the first portion comprises means for anchoring on the support.

6. The roadway widening structure according to claim 1, wherein the first portion includes a first retaining surface for retaining a coating and the second portion includes a second retaining surface for retaining a coating, the first retaining surface and the second retaining surface being located substantially in the same plane.

7. The roadway widening structure according to claim 6, wherein the second retaining surface includes a triangular shape.

8. The roadway widening structure according to claim 1, wherein the lateral wall of the second portion is common with a wall of the first portion.

9. The roadway widening structure according to claim 1, wherein the second portion comprises on one end thereof, opposite to the first portion, an angle bar extending transverse to a retaining surface of the second portion.

10. A roadway widening structure comprising:

a first portion configured to bear on a support and configured to support a first part of the roadway, the first portion presenting an enclosure configured to receive ballast so as to immobilize the first portion on the support, a second portion cantilevered, secured to the first portion by a lateral wall and configured to support a second part of the roadway, and fastening means for fastening the first portion and the second portion, the fastening means including translation guide elements which comprise rails disposed on the first portion or respectively the second portion and complementarily-shaped guides disposed on the second portion or respectively the first portion.

* * * * *